US009329554B2

(12) United States Patent
Deno

(10) Patent No.: US 9,329,554 B2
(45) Date of Patent: May 3, 2016

(54) SHEET CONVEYING APPARATUS AND IMAGE FORMING APPARATUS

(71) Applicant: CANON KABUSHIKI KAISHA, Tokyo (JP)

(72) Inventor: Kohei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/714,234

(22) Filed: Dec. 13, 2012

(65) Prior Publication Data

US 2013/0156478 A1 Jun. 20, 2013

(30) Foreign Application Priority Data

Dec. 19, 2011 (JP) ..... 2011-277688

(51) Int. Cl.
*B65H 7/10* (2006.01)
*G03G 15/00* (2006.01)

(52) U.S. Cl.
CPC ..... *G03G 15/6561* (2013.01); *G03G 15/6567* (2013.01)

(58) Field of Classification Search
CPC ..... B65H 7/10; B65H 9/12; B65H 2301/361; B41J 13/323; G03G 15/6561
USPC ..... 399/395, 394; 400/630; 271/228, 227, 271/230
See application file for complete search history.

(56) References Cited

U.S. PATENT DOCUMENTS 5,362,041 A * 11/1994 Ryuzaki et al. ..... 271/236
2009/0194936 A1* 8/2009 Choi ..... 271/228

FOREIGN PATENT DOCUMENTS

| | | | | |
|---|---|---|---|---|
| JP | 58-101289 A | | 6/1983 | |
| JP | H03-094275 A | | 4/1991 | |
| JP | H06-001499 A | | 1/1994 | |
| JP | 06127753 A | * | 5/1994 | ..... B65H 9/14 |
| JP | 2001117438 A | * | 4/2001 | ..... G03G 21/00 |
| JP | 2008-051890 A | | 3/2008 | |
| JP | 2009-149400 A | | 7/2009 | |
| JP | 2011-153032 A | | 8/2011 | |

* cited by examiner

*Primary Examiner* — Blake A Tankersley
*Assistant Examiner* — Ruben Parco, Jr.
(74) *Attorney, Agent, or Firm* — Canon USA, Inc. IP Division

(57) ABSTRACT

A sheet conveying apparatus includes first and second conveyance roller pairs, a width-direction shifting unit, first and second drive units, and a control unit. The second conveyance roller pair is arranged downstream of the first conveyance roller pair to nip and convey the sheet conveyed by the first conveyance roller pair, and to bend the sheet. The width-direction shifting unit shifts the sheet nipped by the second conveyance roller pair in a width direction by shifting the second conveyance roller pair in the width direction. The control unit controls the first and second drive units so that a circumferential speed of the first conveyance roller pair is made higher than that of the second conveyance roller pair between when the second conveyance roller pair starts conveying the sheet and when the width-direction shifting unit completes shifting the second conveyance roller pair in the width direction.

18 Claims, 12 Drawing Sheets

SHEET CONVEYING APPARATUS AND IMAGE FORMING APPARATUS

BACKGROUND OF THE INVENTION

1. Field of the Invention

The present invention relates to a sheet conveying apparatus that corrects the skew and the width-direction position of a sheet and to an image forming apparatus that includes the sheet conveying apparatus.

2. Description of Related Art

Conventionally, to align a sheet with the position of an image to be formed on the sheet, an image forming apparatus includes a skew correction mechanism and a width-direction correction mechanism. The skew correction mechanism corrects the skew of the conveyed sheet, and the width-direction correction mechanism corrects the position of the sheet in a direction (sheet width direction) perpendicular to a sheet conveyance direction.

If a conveyed sheet is conveyed obliquely, the skew correction mechanism corrects and straightens the orientation of the sheet. If a sheet is displaced while being conveyed or during skew correction by the skew correction mechanism, the width-direction correction mechanism corrects the displacement from a conveyance reference position in the sheet width direction.

Japanese Patent Publication No. 58-101289 discusses a skew correction mechanism. According to this publication, to correct the skew of the leading edge of a conveyed sheet, an upper roller pair arranged upstream of a registration roller pair causes the leading edge of the conveyed sheet to come into contact with the registration roller pair and causes the sheet to form a loop. In addition, Japanese Patent Publication No. 58-101289 discusses a width-direction correction mechanism. According to this publication, to correct the sheet position in the sheet width direction, the registration roller pair shifts a straightened sheet in the sheet width direction while the sheet is pinched by an upstream roller pair and the registration roller pair.

However, if the sheet position in the sheet width direction is corrected by shifting the registration roller pair in the sheet width direction while being pinched, the sheet may be greatly twisted. As a result, the sheet may be wrinkled or torn.

To solve such a problem, Japanese Patent Application Laid-Open No. 2011-153032 discusses a sheet conveying apparatus that separates the upstream roller pair from the sheet when shifting the registration roller pair in the width direction to correct the sheet position in the sheet width direction.

However, the sheet conveying apparatus discussed in Japanese Patent Application Laid-Open No. 2011-153032 requires a mechanism for separating the upstream roller pair. Consequently, the apparatus is made complex and the cost is increased.

SUMMARY OF THE INVENTION

The present invention is directed to a sheet conveying apparatus capable of correcting the sheet position in the sheet width direction with a simple configuration and without damaging the sheet.

According to an aspect of the present invention, a sheet conveying apparatus includes a first conveyance roller pair configured to nip and convey a sheet, a second conveyance roller pair arranged downstream of the first conveyance roller pair and configured to nip and convey the sheet conveyed by the first conveyance roller pair, and to form a nip portion that comes into contact with a leading edge of the sheet conveyed by the first conveyance roller pair to bend the sheet, a width-direction shifting unit configured to shift the sheet nipped by the second conveyance roller pair in a width direction, perpendicular to a sheet conveyance direction, by shifting the second conveyance roller pair in the width direction, a first drive unit configured to rotate the first conveyance roller pair, a second drive unit configured to rotate the second conveyance roller pair, and a control unit configured to control the first and second drive units so that a circumferential speed of the first conveyance roller pair is made higher than that of the second conveyance roller pair between when the second conveyance roller pair starts conveying the sheet and when the width-direction shifting unit completes shifting the second conveyance roller pair in the width direction.

According to an exemplary embodiment of the present invention, the control unit controlling the first and second driving units sets the circumferential speed of the first conveyance roller pair to be higher than the circumferential speed of the second roller pair between when the second conveyance roller pair starts conveying the sheet and when the width-direction correction unit completes shifting the second roller pair in the width direction. Thus, the skew and the width-direction position of the sheet can be corrected with a simple configuration.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 11:
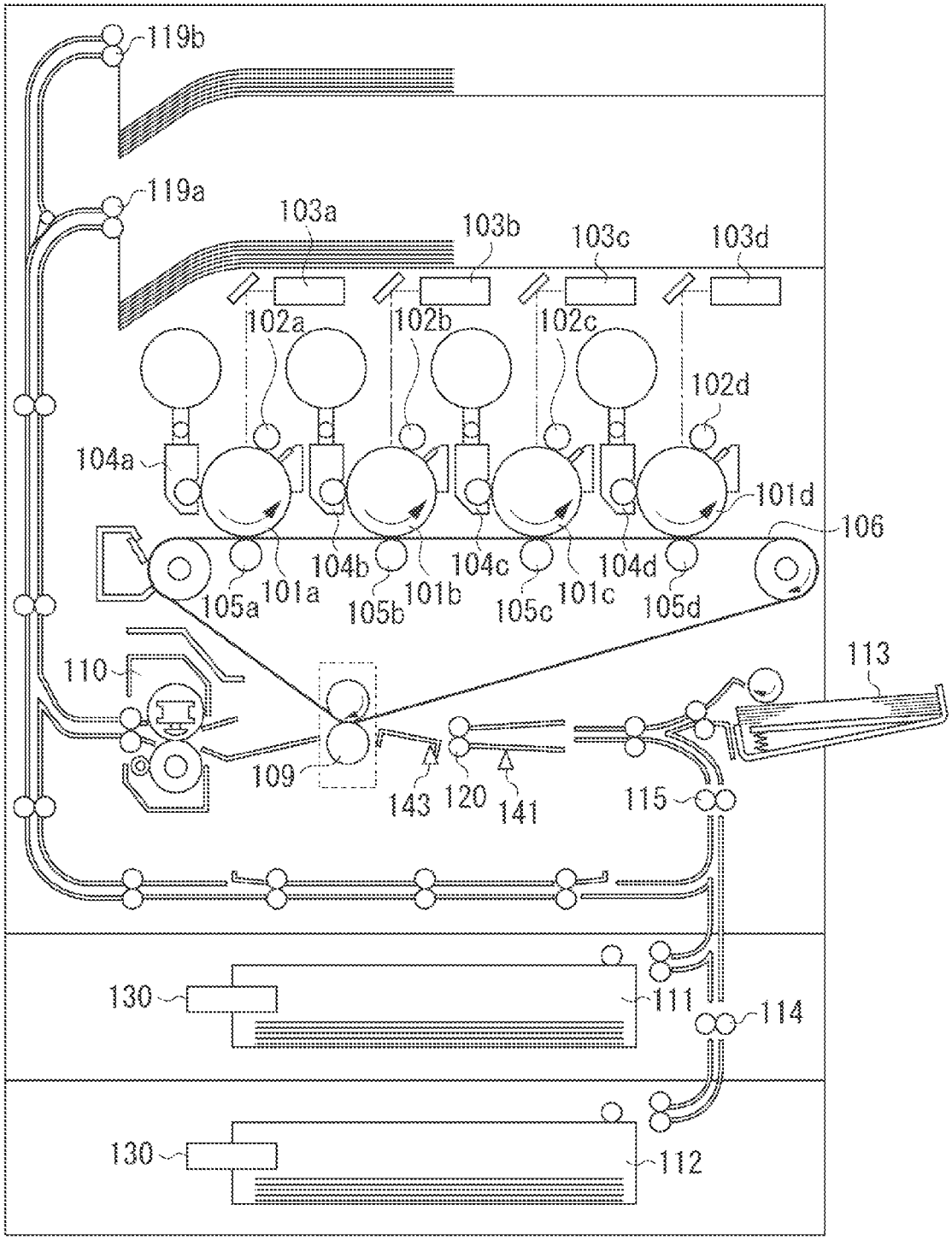
FIG. 11 illustrates an overall configuration of an image forming apparatus according to an exemplary embodiment.

FIG. 11 is a schematic cross section of a color digital printer as an example of an image forming apparatus in which a sheet conveying apparatus is used.

First, an image forming unit will be described. Surfaces of four photosensitive drums 101*a* to 101*d* are charged by respective charging rollers 102*a* to 102*d* with uniform electric charges. Laser scanners 103*a* to 103*d* receive image signals of yellow (Y), magenta (M), cyan (C), and black (K), respectively. Based on these image signals, the laser scanners 103*a* to 103*d* irradiate the surfaces of the photosensitive drums 101*a* to 101*d*, respectively, with laser beams, neutralize electric charges, and form latent images.

Developing devices 104*a* to 104*d* use yellow, magenta, cyan, and black toner to develop the latent images formed on the photosensitive drums 101*a* to 101*d*, respectively. Primary transfer rollers 105*a* to 105*d* sequentially transfer the toner developed on the respective photosensitive drums 101*a* to 101*d* onto an intermediate transfer belt 106, which is an endless-belt image carrier. In this way, a full-color toner image is formed on the intermediate transfer belt 106.

A sheet fed from a sheet feed unit of a sheet cassette 111 or 112 is conveyed by a conveyance roller pair 114 and a first conveyance roller pair 115 to a registration roller pair 120 as a second conveyance roller pair. Alternatively, a sheet can be fed and conveyed from the manual sheet feed unit 113 to the registration roller pair 120. The toner image on the intermediate transfer belt 106 is controlled so that the image is not displaced from the sheet conveyed by the registration roller pair 120. A secondary transfer outer roller 109 transfers the toner image onto the sheet. Next, a fixing device 110 applies heat and pressure to the sheet to fix the toner image on the sheet. Next, the sheet is discharged to the outside of the apparatus main body via a discharging portion 119*a* or 119*b*.

A user uses an operation unit 200 (see FIG. 4) of the image forming apparatus to input various sheet information (size information, grammage information, surface property information, etc.) to a control unit. Alternatively, a user can input various sheet information to the control unit from a computer 201 connected to the image forming apparatus via a network.

Each of the sheet cassettes 111 and 112 includes a size detection unit 130 detecting the size of the stored sheets and notifying the control unit in the image forming apparatus of the size. Each of the size detection units 130 includes a rotatable size detection lever that slidably comes into contact with and operates with a side regulating plate. The side regulating plate regulates the position of the sheets in the width direction. The side regulating plate can be shifted depending on a sheet side edge and can adjust the sheet position in the width direction with respect to the image forming unit.

Each of the size detection units 130 includes a plurality of sensors or switches at a position corresponding to the corresponding size detection lever at a mounting portion of the apparatus main body into which the corresponding sheet cassette is loaded. Thus, if a side regulating plate is shifted depending on a sheet side edge, the corresponding size detection lever is accordingly rotated. When the sheet cassette 111 or 112 is loaded into the image forming apparatus, the corresponding size detection lever selectively turns on/off the detection elements of the sensors or switches arranged at the mounting portion of the apparatus main body. In this way, a different-pattern signal is transmitted from the sensors or switches to the image forming apparatus main body. As a result, based on the signal, the image forming apparatus main body can recognize the size of the sheets stored in the sheet cassette 111 or 112. A similar mechanism can be arranged in the manual sheet feed unit 113 as a size detection unit.

Each of the side regulating plates has a function of preventing the skew of a sheet caused during sheet feeding. However, in reality, if a gap is caused between a side regulating plate and a sheet, the sheet can be skewed. In addition, a sheet fed from a sheet feed unit can be skewed while being conveyed.

Thus, the image forming apparatus according to the present exemplary embodiment includes a sheet conveying apparatus that corrects such sheet skew. The sheet conveying apparatus causes the leading edge of a sheet conveyed by the first conveyance roller pair to come into contact with the nip portion of the stopped registration roller pair 120 and bends the sheet. In this way, the skew of a sheet can be corrected by causing the leading edge of the sheet to abut on the nip portion while causing the sheet to form a loop. The amount of the loop (bend) formed by the sheet should be sufficient enough to cause the leading edge of the sheet to come into contact with the nip portion of the registration roller pair 120 without fail to abut on the nip portion. For this reason, the loop amount (bend amount) is set by causing the first conveyance roller pair 115 arranged upstream of the registration roller pair 120 to convey the sheet by a predetermined amount, after the sheet passes by a registration sensor 141.

Figure 1:
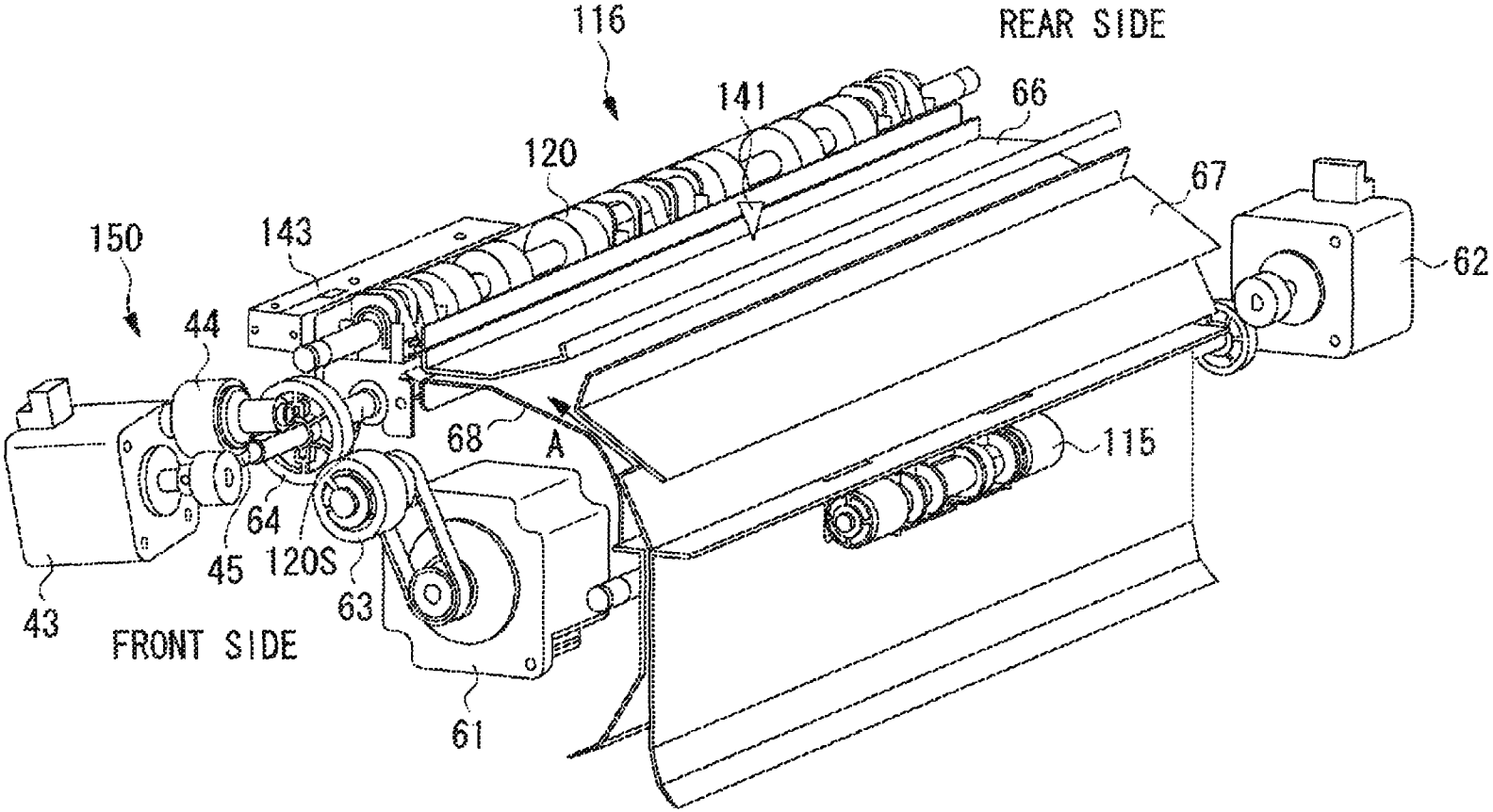
FIG. 1 illustrates a sheet conveying apparatus according to a first exemplary embodiment.

Next, the sheet conveying apparatus according to the first exemplary embodiment will be described. FIG. 1 is a perspective view illustrating a sheet conveying apparatus 116 that is arranged in a sheet conveyance path connecting the sheet cassettes 111 and 112 and the image forming unit and that corrects the skew and the width-direction position of a sheet. FIGS. 2A to 2D and FIGS. 3A to 3D schematically illustrate an operation of correcting the skew and the width-direction position of a sheet, which is executed by the sheet conveying apparatus 116.

The first conveyance roller pair 115 arranged in the sheet conveyance path is formed by a first upper roller 115*a* including a polyacetal/polyoxymethylene (POM) roller and a first lower roller 115*b* formed by a rubber roller. These rollers 115*a* and 115*b* are arranged to face each other. The first upper roller 115*a* is swingably supported by a lever or the like and is pressed against the first lower roller 115*b* by elastic force of a spring (not illustrated).

The registration roller pair 120, which is arranged downstream of the first conveyance roller pair 115 and serves as an abutment portion with which the leading edge of a conveyed sheet comes into contact to correct a sheet skew, includes an upper roller 120*a* and a lower roller 120*b*. The skew of a sheet is corrected by causing the sheet to come into contact with the nip portion between the upper roller 120*a* and the lower roller 120*b* so that the leading edge of the sheet abuts on the nip portion. The upper roller 120*a* of the registration roller pair 120 includes a polyacetal (POM) roller and the lower roller 120*b* is formed by a rubber roller. These upper and lower rollers 120*a* and 120*b* are arranged to face each other. In addition, the upper roller 120*a* is swingably supported by a lever or the like and is pressed against the lower roller 120*b* by elastic force of a spring (not illustrated). The lower roller 120*b* of the registration roller pair 120 is fixed to a registration roller rotation shaft 120S and is fixed to the apparatus main body movably in the sheet width direction of the registration roller rotation shaft 120S. The upper and lower rollers 120*a* and 120*b* can be shifted integrally in the sheet width direction, as the registration roller rotation shaft 120S shifts in the sheet width direction.

In FIG. 1, the sheet conveying apparatus 116 includes a first conveyance roller pair drive motor 62 serving as a first drive unit for driving the first lower roller 115*b* of the first conveyance roller pair 115 and a registration motor 61 serving as a second drive unit for driving the lower roller 120*b* of the registration roller pair 120.

In addition, the sheet conveying apparatus 116 includes a width-direction shifting unit 150 for shifting the registration roller pair 120 in the width direction perpendicular to the sheet conveyance direction. The width-direction correction unit 150 shifts a sheet pinched by the registration roller pair 120 in the width direction by shifting the registration roller pair 120 in the width direction. The width-direction shifting unit 150 includes a shift motor 43, a pinion gear 44, and a rack 45. The rack 45 is rotatable in the rotational direction of the registration roller rotation shaft 120S and fixedly supported in the sheet width direction.

With this configuration, when the shift motor 43 is driven and the pinion gear 44 is rotated, the rack 45 is shifted in the sheet width direction. In this way, the registration roller pair 120 can be shifted in the sheet width direction, and the sheet pinched by the registration roller pair 120 can be shifted in the width direction. A registration roller idler gear 63 has a larger face width than that of a registration roller input gear 64. This is to maintain engagement of the gears and to enable rotation of the registration roller pair 120 even when the registration roller pair 120 and the registration roller input gear 64 are shifted in the width direction.

Between the first conveyance roller pair 115 and the registration roller pair 120, the sheet conveying apparatus 116 includes upper guides 66 and 67 and a lower guide 68 for guiding a conveyed sheet. A gap is partially provided between the pair of upper guides 66 and 67 and the lower guide 68. This gap is formed to allow the conveyed sheet to form a loop when the sheet comes into contact with the nip portion of the registration roller pair 120.

In addition, the sheet conveying apparatus 116 includes a contact image sensor (CIS) 143 as a detection unit that is arranged downstream of the registration roller pair 120 and that detects the position of a sheet side edge. The CIS 143 is arranged upstream of an image transfer unit and is displaced from the center in the sheet width direction. This is because it is sufficient that the CIS 143 detects one side edge of the sheet. In addition, lengths are set so that a minimum width sheet and a maximum width sheet can be detected.

Next, an operation of correcting the skew and the width direction of a sheet which is executed by the sheet conveying apparatus 116 will be described with reference to FIGS. 2A to 2D and FIGS. 3A to 3D. FIGS. 2A to 2D are top views and FIGS. 3A to 3D are side views. FIGS. 2A to 2D correspond to FIGS. 3A to 3D, respectively.

Figure 2A:
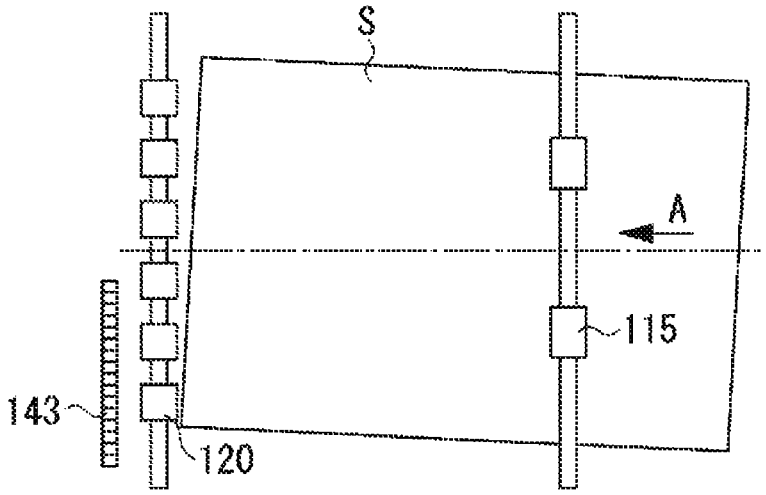
FIGS. 2A, 2B, 2C, and 2D illustrate an operation of correcting the skew and width-direction position of a sheet according to the first exemplary embodiment.

An operation of correcting a sheet S that is skewed to the left side in conveyance direction A as illustrated in FIG. 2A will be described. From the state in FIG. 2A, if the first conveyance roller pair 115 is rotated and the sheet S is conveyed in conveyance direction A, the left-side leading edge of the sheet S in conveyance direction A comes into contact with the nip portion of the registration roller pair 120. In FIG. 2A, the registration roller pair 120 is stopped.

Figure 2B:
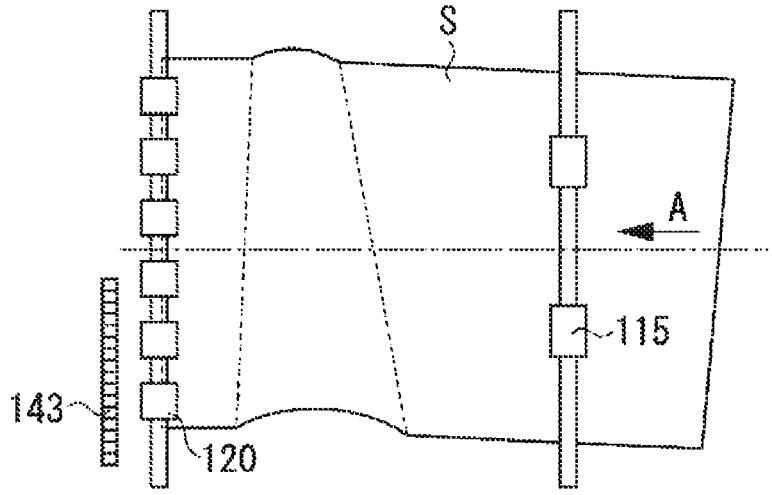
Figure 3A:
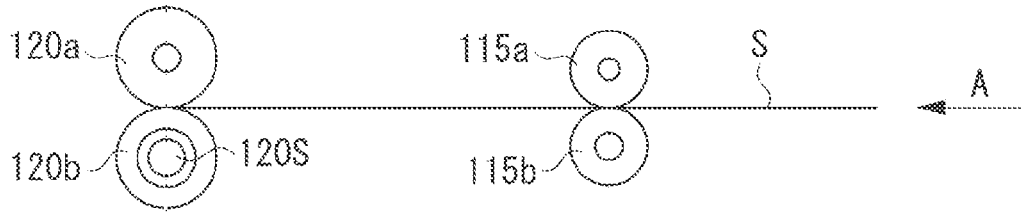
FIGS. 3A, 3B, 3C, and 3D illustrate the operation of correcting the skew and width-direction position of a sheet according to the first exemplary embodiment.
Figure 3B:
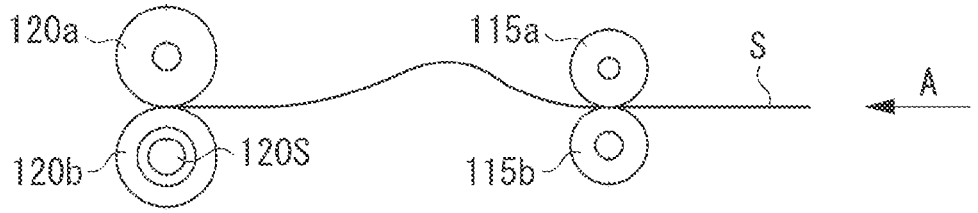

If the first conveyance roller pair 115 is rotated and the sheet S is further conveyed in conveyance direction A, as illustrated in FIG. 2B and FIG. 3B, the entire leading edge of the sheet S in conveyance direction A comes into contact with the nip portion of the registration roller pair 120. In this state, the leading corner portion of the skewed sheet S abuts on the nip portion of the registration roller pair 120 to stop, and a loop is gradually formed by the sheet S. Accordingly, the other leading edge of the sheet S is rotated so that the corner portion opposite to the corner portion abutting on the nip portion comes closer to the nip portion. A loop is formed by the sheet S between the registration roller pair 120 and the first conveyance roller pair 115. In this way, the entire leading edge of the sheet S comes into contact with the nip portion of the registration roller pair 120, and the skew is corrected.

The loop formed by the sheet S when the skew of the sheet S is corrected is suitably set based on the sheet size or grammage, for example (hereinafter referred to as sheet information). A controller 50 can determine an optimum loop amount, based on sheet information specified by a user via the operation unit 200 and/or sheet information detected by the size detection unit 130.

Figure 2C:
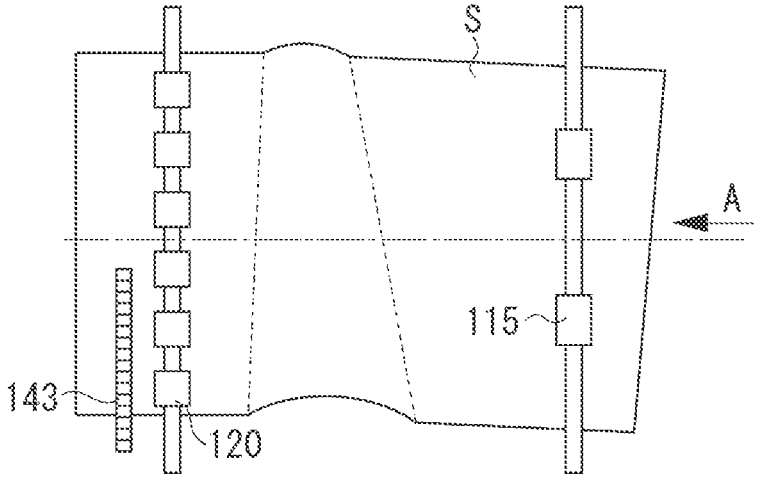
Figure 3C:
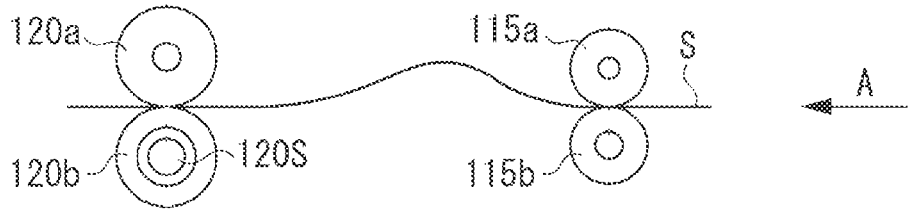

Next, the registration roller pair 120 is rotated, and the sheet S whose skew has been corrected is conveyed as illustrated in FIG. 2C and FIG. 3C. The CIS 143 detects a side edge of the sheet S conveyed by the registration roller pair 120.

The controller 50 causes the width-direction shifting unit 150 to shift the registration roller pair 120 in the width direction, based on a detection result of the CIS 143.

Figure 2D:
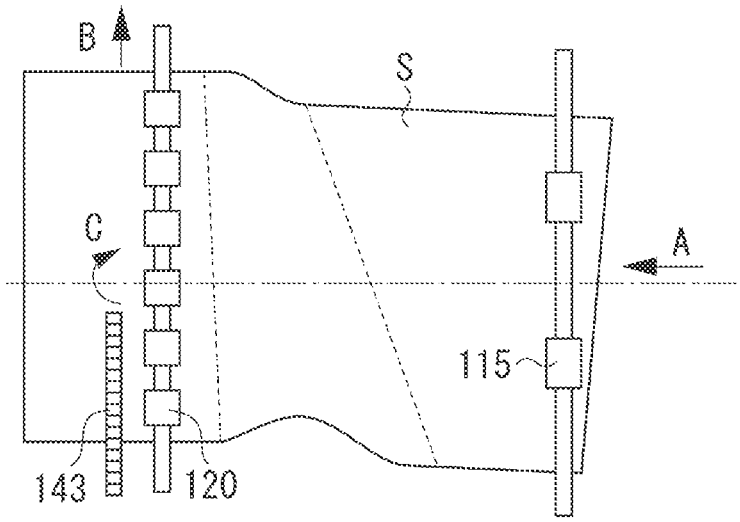
Figure 3D:
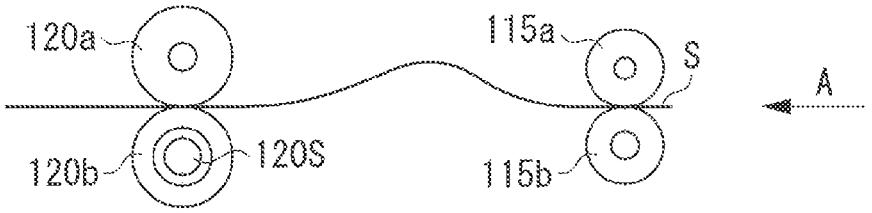

Next, as illustrated in FIG. 2D and FIG. 3D, the width-direction shifting unit 150 shifts the registration roller pair 120 in the direction of arrow B. Consequently, the sheet position in the width direction is corrected.

In this operation, before the width-direction shifting unit 150 shifts the registration roller pair 120, the controller 50 increases the conveyance speed of the first conveyance roller pair 115. In this way, as illustrated in FIG. 2D and FIG. 3D, the amount of the loop formed by the sheet is increased. Next, by rotating the registration roller pair 120 and the first conveyance roller pair 115, the sheet is conveyed without a skew or a width-direction displacement.

Next, why the amount of the loop formed by the sheet is increased before the width-direction shifting unit 150 shifts the registration roller pair 120 in the width direction will be described.

When the sheet position in the width direction is corrected, if the registration roller pair 120 is shifted in the sheet width direction, the sheet is shifted while being nipped by the registration roller pair 120 and the first conveyance roller pair 115. Thus, as illustrated in FIG. 2D, the sheet is twisted in the direction of arrow C between the registration roller pair 120 and the first conveyance roller pair 115.

In addition, if the force twisting the sheet in the direction of arrow C exceeds the force of the registration roller pair 120 pinching the sheet, the sheet slips at the nip portion of the registration roller pair 120. As a result, the sheet can be skewed or wrinkled. In particular, if a sheet having large stiffness such as a thick paper is used, the force twisting the sheet is large. As a result, the sheet is easily skewed or wrinkled.

In such a case, when the sheet position in the width direction is corrected, if the amount of a loop formed by the sheet is large, the force twisting the sheet can be absorbed. Thus, the sheet does not easily slip at the nip portion of the registration roller pair 120. However, when the skew of a sheet having small stiffness such as a thin sheet is corrected, if the loop amount is excessively large, the sheet is buckled. As a result, the sheet skew correction performance is deteriorated. Namely, when the sheet in the width direction is corrected, it is desirable that the amount of the loop formed by the sheet is larger. However, when the sheet skew is corrected, if the amount of the loop formed by the sheet is excessively large, the skew correction performance can be deteriorated.

According to the first exemplary embodiment made in view of such circumstances, before the width-direction shifting unit 150 shifts the registration roller pair 120 in the sheet width direction, the amount of the loop formed by the sheet is increased. In this way, when the sheet is shifted in the width direction, twisting of the sheet is absorbed. As a result, since the sheet does not slip at the nip portion of the registration roller pair 120, the sheet is not skewed or wrinkled.

Next, the control unit of the sheet conveying apparatus 116 according to the first exemplary embodiment will be described, along with a flow of operations of correcting the skew and the width-direction position of a sheet by this control unit.

Figure 4:
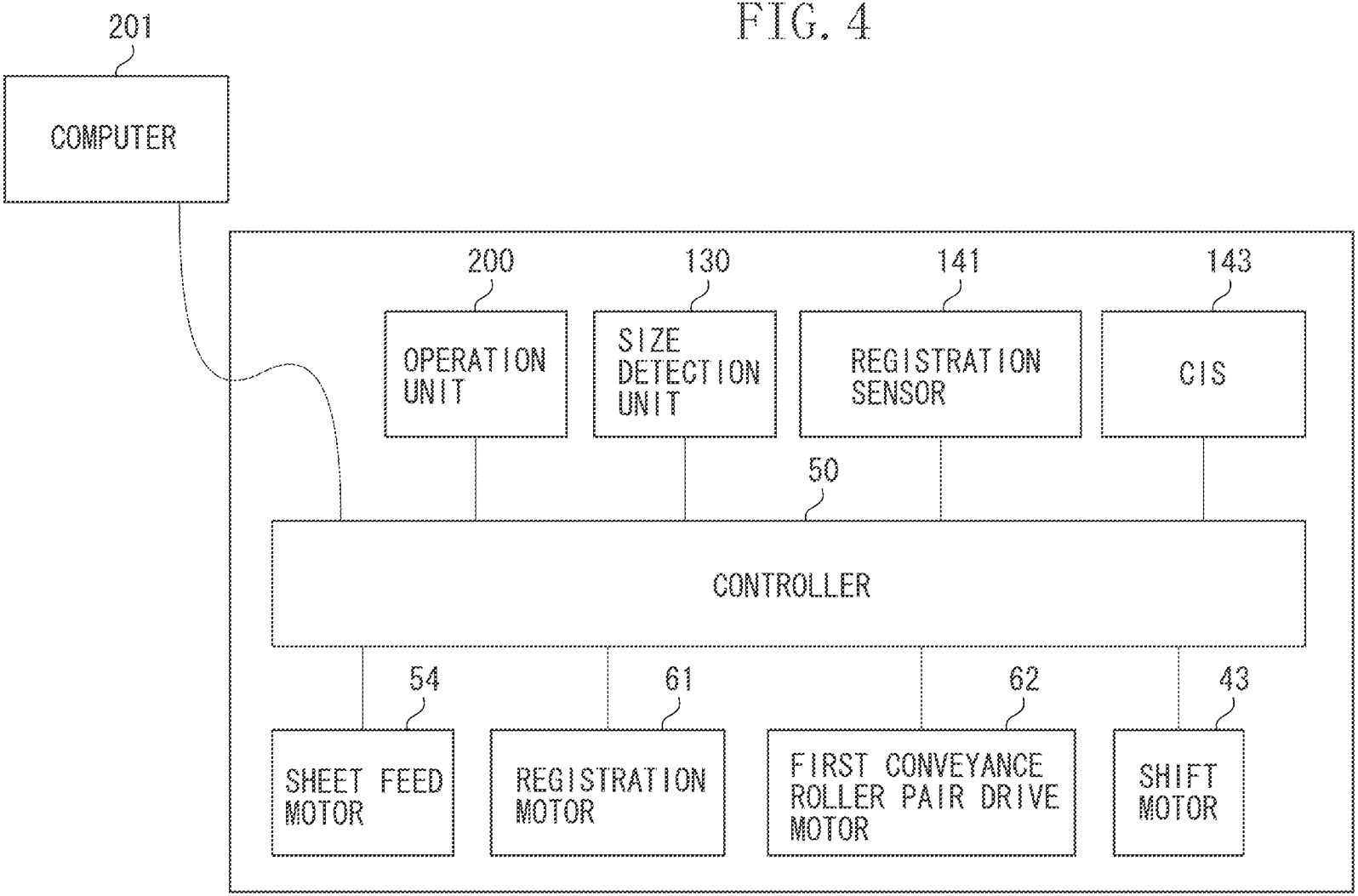
FIG. 4 is a block diagram of an image forming apparatus according to the first exemplary embodiment.

First, as illustrated in the block diagram of FIG. 4, the controller 50 as the control unit is connected to the operation unit 200 and the size detection unit 130 of the image forming apparatus. The controller 50 is also connected to the registration sensor 141, the registration motor 61 as the second drive unit, a sheet feed motor 54, the first conveyance roller pair drive motor 62 as the first drive unit, the CIS 143, and the shift motor 43.

Figure 5:
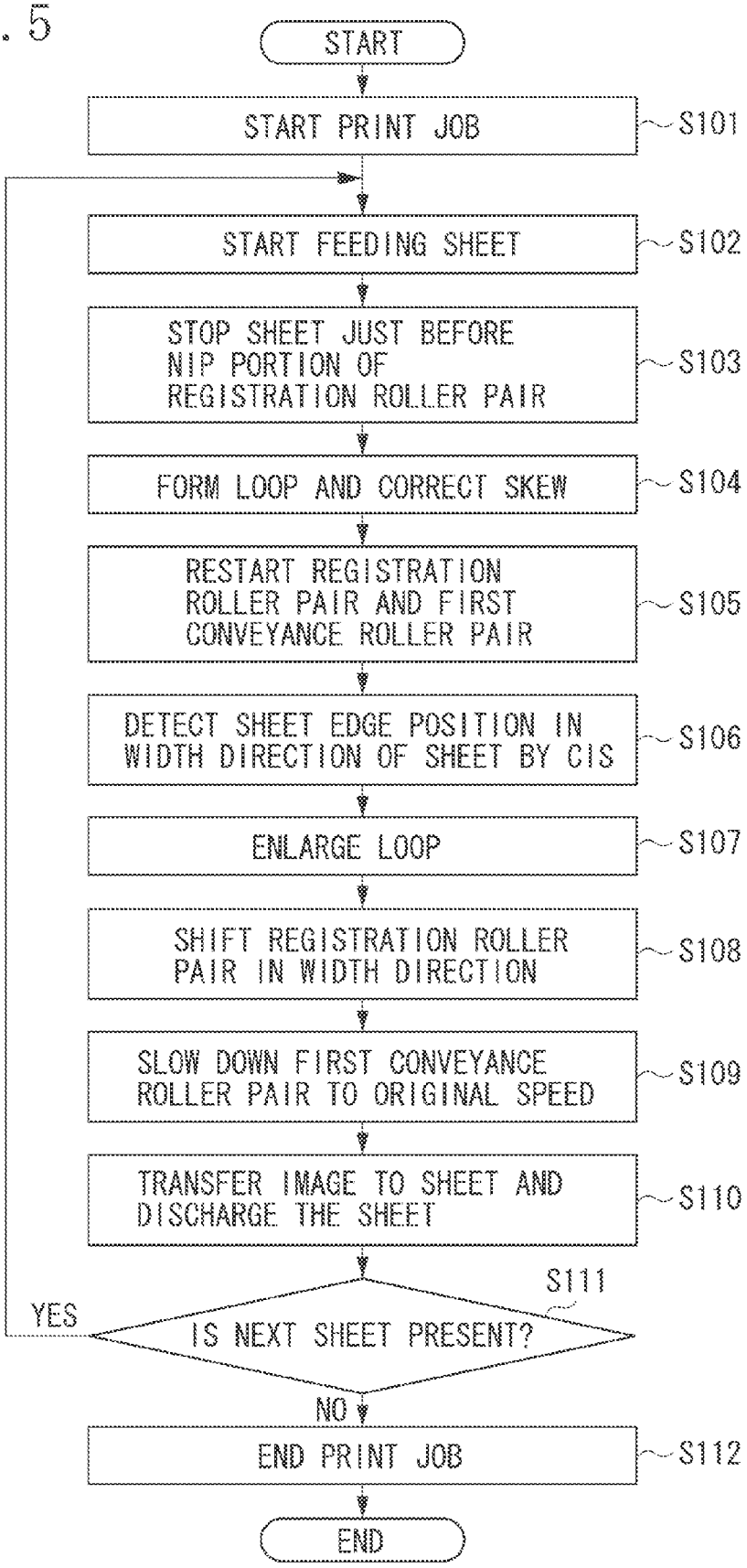
FIG. 5 is a flow chart illustrating the operation of correcting the skew and width-direction position of a sheet executed by the sheet conveying apparatus according to the first exemplary embodiment.

The control flow executed by the control unit will be described with reference to FIG. 5. First, in step S101, a user uses the operation unit 200 of the image forming apparatus or the computer 201 connected to the image forming apparatus directly or via a network to start a print job. The user can specify sheet information about a sheet to be used, along with the number of prints and the like. The sheet information can be detected by the size detection unit 130.

In step S102, after the print job is started, a sheet feed operation is started, and a sheet is conveyed to the first conveyance roller pair 115 and the registration sensor 141. In step S103, when the registration sensor 141 detects the conveyed sheet, the first conveyance roller pair 115 stops rotating and temporarily stops the sheet just before the nip portion of the registration roller pair 120. This is to cause the leading edge of the sheet to come into contact with the nip portion of the registration roller pair 120 at low speed.

The controller 50 previously stores a table in which sheet information and amounts of loops formed by sheets are associated with each other. Based on sheet information about the conveyed sheet, the controller 50 refers to the table and determines an amount of a loop formed by the sheet when the skew of the sheet is corrected.

Next, in step S104, after a predetermined period of time elapses, the controller 50 controls the first conveyance roller pair drive motor 62 to start rotating the first conveyance roller pair 115 and to correct the skew by causing the sheet to form a loop.

Next, in step S105, by simultaneously restarting the registration roller pair 120 and the first conveyance roller pair 115, the controller 50 conveys the sheet whose skew has been corrected in the downstream direction.

In step S106, the CIS 143 detects a sheet edge position in the width direction of the sheet conveyed downstream of the registration roller pair 120.

Next, in step S107, the controller 50 controls the first conveyance roller pair drive motor 62 and the registration motor 61 so that the sheet conveyance speed of the first conveyance roller pair 115 is made greater than that of the registration roller pair 120. More specifically, the controller 50 increases the circumferential speed of the first conveyance roller pair 115 to be greater than that of the registration roller pair 120. In this way, the skew correction unit temporarily enlarges the loop formed when the sheet skew is corrected. If the loop is excessively enlarged, the sheet is excessively bent by the loop. As a result, the sheet is buckled or slipped. Thus, in step S107, the loop is enlarged by an appropriate amount so that the sheet is not buckled or slipped.

Next, in step S108, the controller 50 controls the width-direction shifting unit 150 so that the registration roller pair 120 shifts in the width direction to correct the sheet position in the width direction. The controller 50 calculates an amount of displacement in the width direction between the sheet edge position detected by the CIS 143 and a normal position. Next, the controller 50 controls the shift motor 43 so that the registration roller pair 120 shifts in the width direction by the calculated amount of displacement. In this way, the sheet position in the width direction is corrected. The above normal position is a sheet edge position when the sheet is conveyed without displacement in the width direction. The normal position is determined for each sheet size. The controller 50 previously stores a table in which each sheet size is associated with a sheet edge normal position in the width direction. Based on the edge position in the width direction detected by the CIS 143, the controller 50 refers to the table and determines an amount by which the registration roller pair 120 shifts the sheet in the width direction.

After the registration roller pair 120 shifts the sheet in the width direction by the determined shift amount, in step S109, the controller 50 slows down the speed of the first conveyance roller pair 115, which has been temporarily increased to enlarge the loop, to an original speed. The controller 50 slows down the speed to the original speed between when the registration roller pair 120 completes shifting the sheet in the width direction and when the leading edge of the sheet reaches a secondary transfer unit.

After the position in the width direction is corrected, the sheet is conveyed to the secondary transfer unit. In step S110, an image is transferred to the sheet, and the sheet is discharged. Next, in step S111, the controller 50 determines whether the next sheet is present. If the next sheet is not present (NO in step S111), the controller 50 ends the print job.

Figure 6:
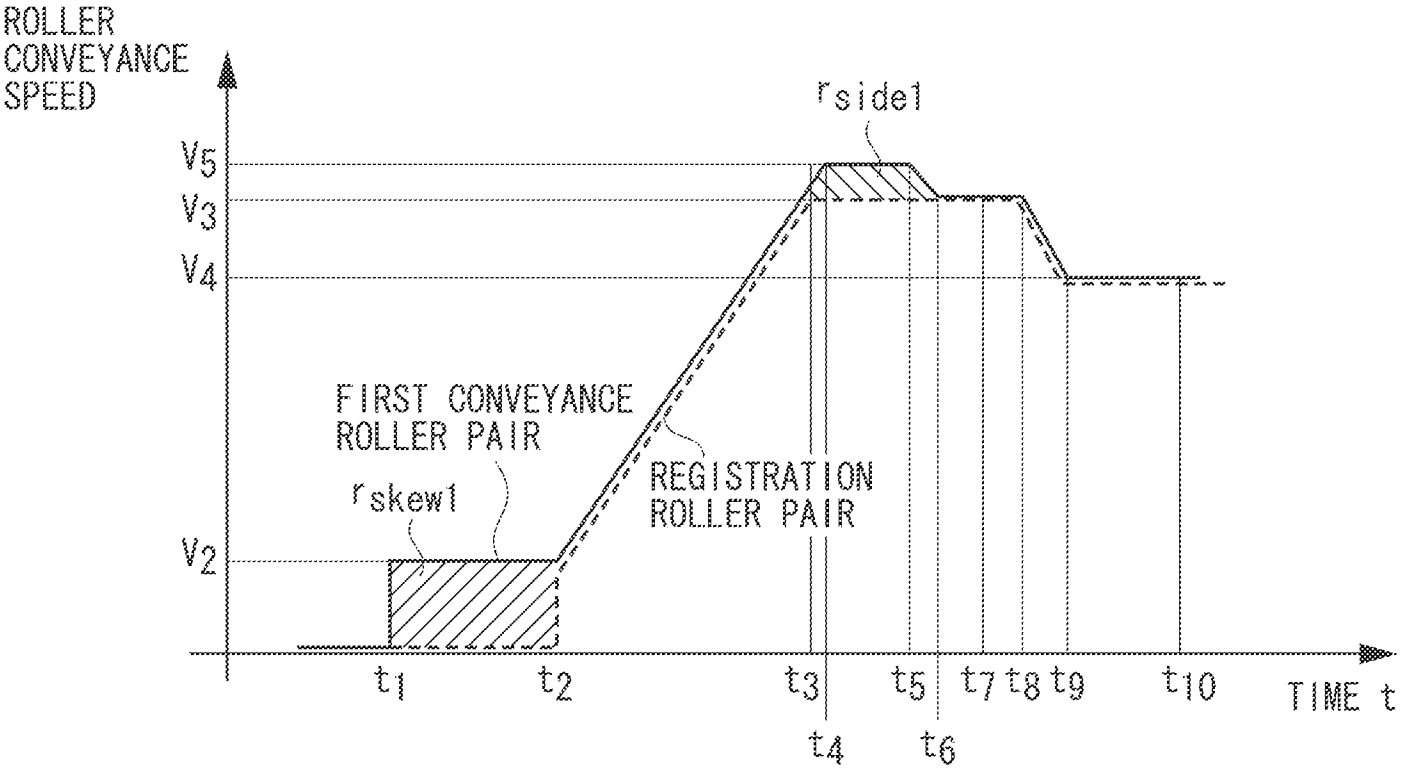
FIG. 6 is a graph illustrating drive operations of motors according to the first exemplary embodiment.

FIG. 6 is a graph illustrating drive operations of the registration motor 61 and the first conveyance roller pair drive motor 62. The graph corresponds to the above flow. In FIG. 6, the vertical axis represents sheet conveyance speed by driving of the motors 61 and 62 and the horizontal axis represents time. A dashed line represents sheet conveyance speed by the registration roller pair 120 and a solid line represents sheet conveyance speed by the first conveyance roller pair 115.

At time $t_1$, the controller 50 starts to activate the first conveyance roller pair drive motor 62, which has stopped the sheet just before the registration roller pair 120, and rotates the first conveyance roller pair 115 at a constant speed $v_2$. Before time $t_2$ when rotation of the registration motor 61 is started, a skew correction loop for the amount of $r_{skew1}$ is formed. After the loop is formed, the controller 50 simultaneously restarts and accelerates the registration roller pair 120 and the first conveyance roller pair 115 until time $t_3$. Subsequently, the controller 50 rotates the registration roller pair 120 at the constant speed $v_3$ and accelerates the first conveyance roller pair 115 up to speed $v_5$. In this way, because of the difference between these two speeds $v_3$ and $v_5$, the loop amount $r_{skew1}$ is enlarged to a loop amount $r_{side1}$. Next, between time $t_5$ to time $t_6$, the controller 50 slows down the speed $v_5$ of the first conveyance roller pair 115 to the speed $v_3$. Next, at time $t_2$, the position in the width direction is corrected, and between time $t_8$ and time $t_9$, the controller 50 slows down the speed of the both rollers to an image forming process speed $v_4$. In this way, the sheet is conveyed to the secondary transfer unit at time $t_{10}$ by the both rollers at the same speed.

While the sheet is temporarily stopped just before the nip portion of the registration roller pair 120 in the above description, the present invention is not limited to such an example. By separating the first conveyance roller pair 115 before a loop is formed by the sheet, similar beneficial effects as those described above can be obtained.

Figure 7:
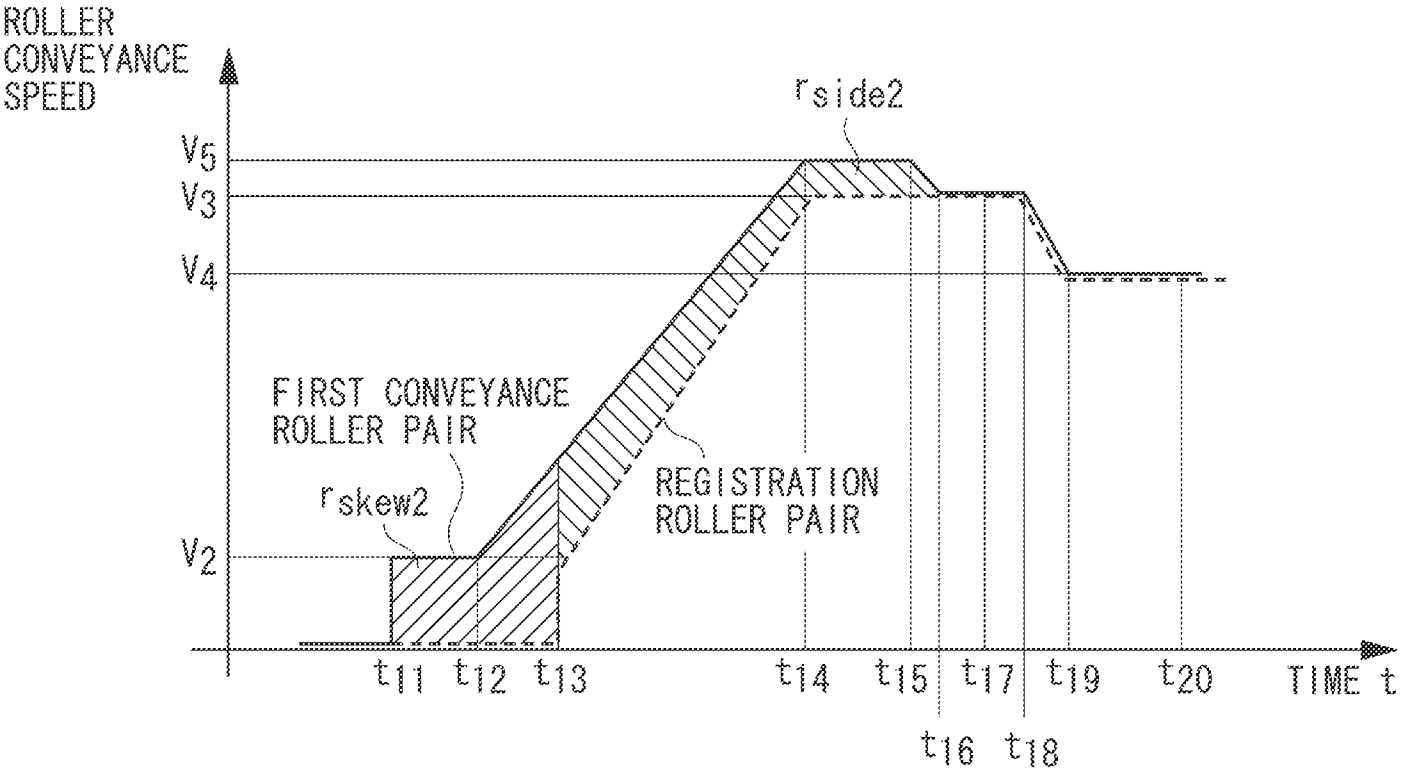
FIG. 7 is a graph illustrating drive operations of motors according to the first exemplary embodiment.

In addition, in the above description, the amount of the loop formed by the sheet in correcting the sheet position in the width direction is enlarged by accelerating the speed of the first conveyance roller pair 115 at time $t_3$ after skew correction. However, the present invention is not limited to such an example. The amount of the loop formed by the sheet may be enlarged by other techniques. For example, as illustrated in FIG. 7, the first conveyance roller pair 115 is started to be accelerated at an earlier time ($t_{12}$). Alternatively, the speed (acceleration) of the first conveyance roller pair 115 from time $t_{12}$ to time $t_{14}$ may be increased to be greater than that of the registration roller pair 120. Still alternatively, the maximum speed (target speed) $v_5$ of the first conveyance roller pair 115 may be increased to be greater than the maximum speed (target speed) $v_3$ of the registration roller pair 120. Namely, the difference in conveyance amount between the first conveyance roller pair 115 and the registration roller pair 120 corresponds to the loop amount. In addition, it is sufficient that a loop amount $r_{skew2}$ be formed between time $t_{11}$ and time $t_{13}$ and a loop amount $r_{side2}$ be formed between time $t_{13}$ and time $t_{17}$ when the registration roller pair 120 shifts and corrects the sheet position in the width direction.

As described above, according to the first exemplary embodiment, the amount of the loop formed by the sheet is enlarged before the width-direction shifting unit 150 shifts the registration roller pair 120 in the width direction.

Thus, according to the first exemplary embodiment, amounts of loops can be appropriately set for skew correction and for width-direction correction, with a simple configuration. Thus, both the skew correction performance and the width-direction correction performance can be ensured.

In addition, in the above first exemplary embodiment, before the width-direction shifting unit 150 shifts the registration roller pair 120, the amount of the loop formed by the sheet is enlarged. However, the present invention is not limited to such an example. Namely, it is sufficient that the amount of the loop formed by the sheet be enlarged before the width-direction shifting unit 150 completes shifting the registration roller pair 120.

Figure 8:
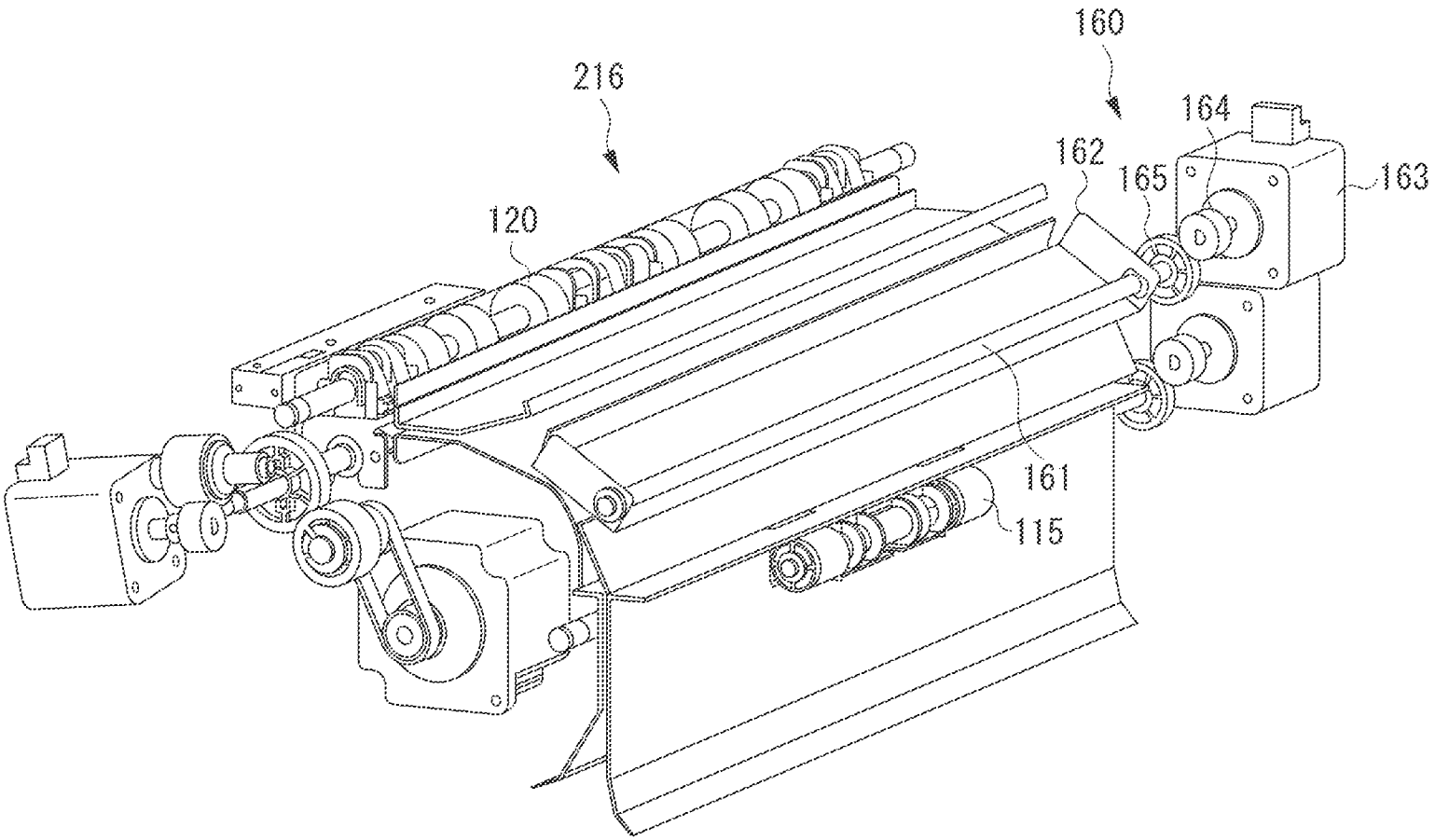
FIG. 8 illustrates a sheet conveying apparatus according to a second exemplary embodiment.

Next, a second exemplary embodiment will be described. FIG. 8 is a side view of a sheet conveying apparatus 216. The second exemplary embodiment is different from the first exemplary embodiment in that the sheet conveying apparatus 216 includes a loop space varying mechanism 160. Since the second exemplary embodiment is the same as the first exemplary embodiment in other aspects, redundant description thereof will be avoided.

The loop space varying mechanism 160 includes a swing guide shaft 161, a swing guide 162 fixed to the swing guide shaft 161, a swing motor 163, a motor gear 164 fixed to the output shaft of the swing motor 163, and an input gear 165 fixed to the swing guide shaft 161. The input gear 165 is engaged with the motor gear 164, and the swing guide 162 is swung when the swing guide shaft 161 is rotated by rotation of the swing motor 163.

This loop space varying mechanism 160 swings the swing guide 162 forming the sheet conveyance path so that the gap between the swing guide 162 and a lower guide 168 is expanded. Namely, the loop space varying mechanism 160 expands the loop space for allowing the sheet to form the loop.

The swing guide shaft 161 is rotatably supported by the apparatus main body frame (not illustrated). If the swing guide drive motor 163 is rotated counterclockwise, the swing guide shaft 161 is rotated clockwise via the motor gear 164 and the input gear 165. Consequently, the swing guide 162 swings upward as illustrated in FIG. 9B. Conversely, if the swing guide drive motor 163 is rotated clockwise, the swing guide 162 swings downward as illustrated in FIG. 9A.

Figure 9A:
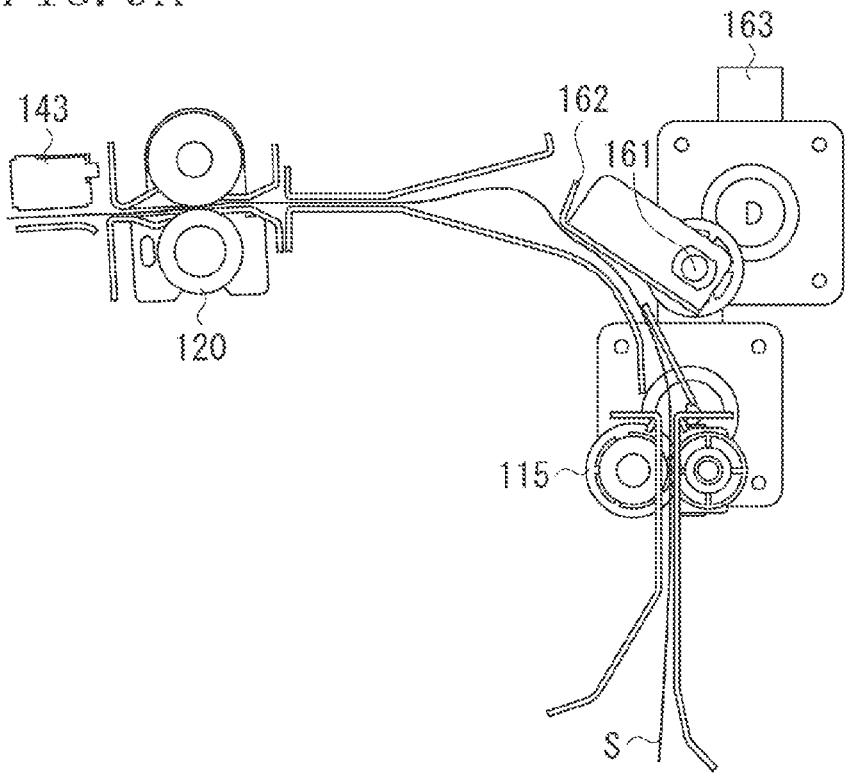
FIGS. 9A and 9B illustrate the sheet conveying apparatus according to the second exemplary embodiment.
Figure 9B:
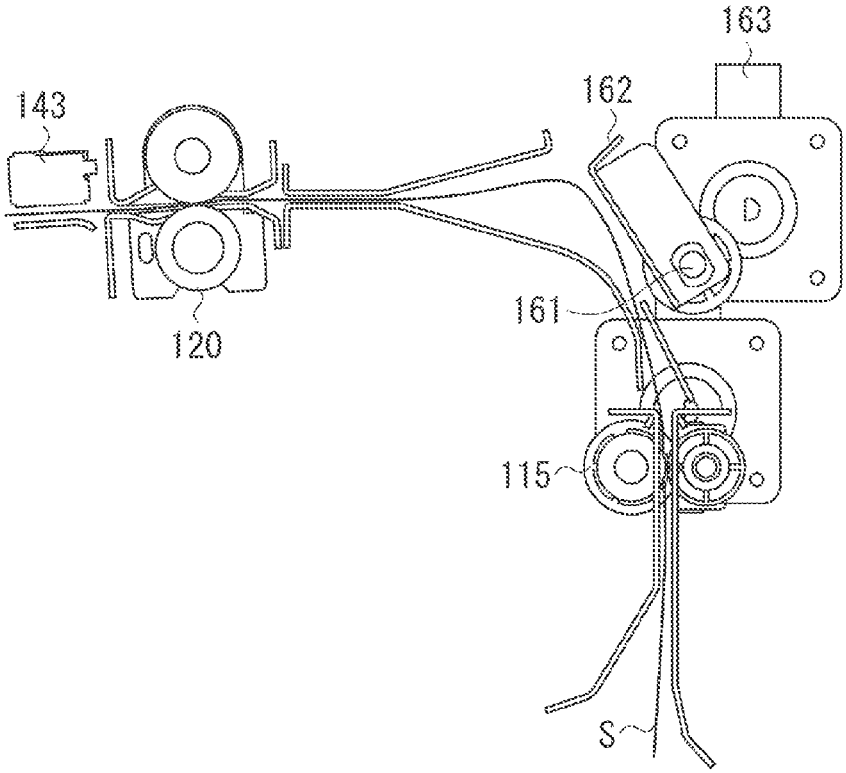

As illustrated in FIG. 9A, the sheet is conveyed by the first conveyance roller pair 115 and is temporarily stopped just before the nip portion of the registration roller pair 120. The swing guide 162 is swung upward between when the sheet is temporarily stopped just before the nip portion of the registration roller pair 120 and when a loop is started to be formed after the sheet is conveyed again and comes into contact with the nip portion of the registration roller pair 120. This is because, if the swing guide 162 is swung upward before the leading edge of the sheet passes by the swing guide 162, the sheet can be buckled. If this happens, the leading edge of the sheet can fail to come into contact with the registration roller pair 120. Likewise, if a loop is formed without temporarily stopping the sheet just before the nip portion of the registration roller pair 120, it is desirable that the swing guide 162 be swung between when the leading edge of the sheet passes by the swing guide 162 and when a loop is formed.

With this configuration according to the second exemplary embodiment, a loop is formed after the swing guide 162 is moved upward and the loop space between the swing guide 162 and the lower guide 168 is expanded, as illustrated in FIG. 9B. Thus, the swing guide 162 does not prevent formation of the loop, and the sheet can form a loop of a desired size. In addition, with the configuration according to the second exemplary embodiment, an increase in loop reaction force, which is caused when the sheet with a loop comes into contact with the swing guide 162, can be prevented.

When using a sheet that can be used in the image forming apparatus and that can greatly be damaged when twisted, a loop as large as possible should be formed, to minimize the reaction force by twisting. In this case, as in the configuration according to the second exemplary embodiment, by expanding the loop space for allowing the sheet to form the loop, the sheet skew correction performance can be improved. However, if the loop space is expanded before the sheet reaches the registration roller pair 120, the gap between the conveyance guides is widened excessively. As a result, the sheet can be skewed greatly or jammed. Thus, until the leading edge of the sheet reaches the registration roller pair 120, the loop space should be maintained in a normal size, to prevent sheet conveyance errors.

Figure 10:
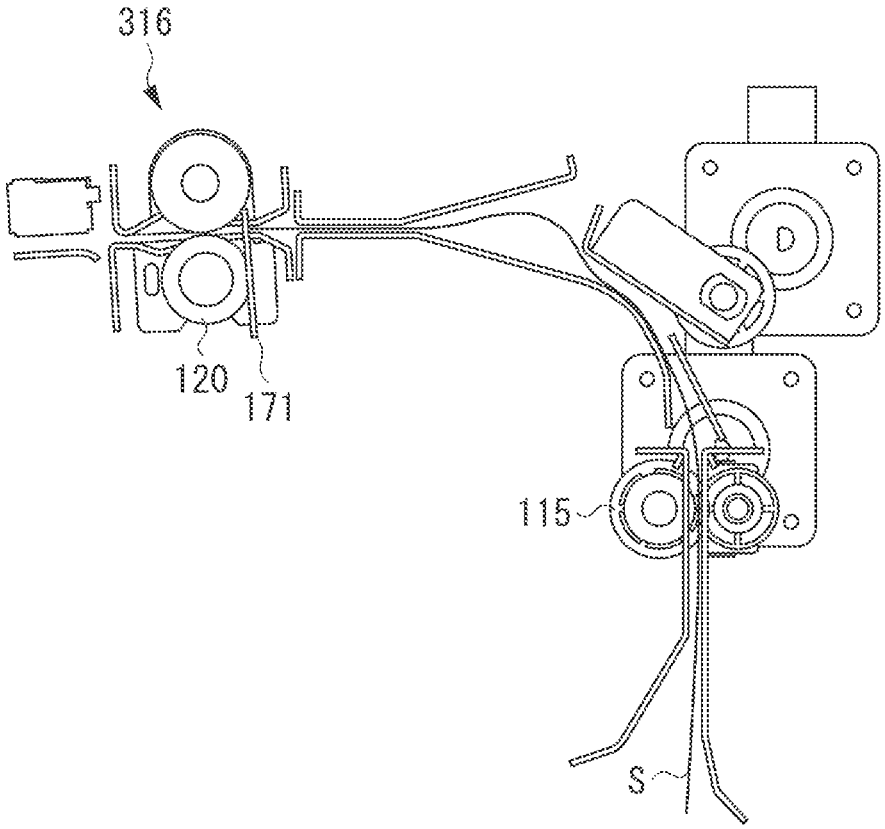
FIG. 10 illustrates a sheet conveying apparatus according to a third exemplary embodiment.

Next, a third exemplary embodiment will be described. FIG. 10 is a side view of a sheet conveying apparatus 316. The third exemplary embodiment is different from the first exemplary embodiment in that the sheet conveying apparatus 316 includes a shutter member 171 as an abutment portion. Since the third exemplary embodiment is the same as the first exemplary embodiment in other aspects, redundant description thereof will be avoided.

In the first exemplary embodiment, to correct the skew of a sheet, the leading edge of the sheet is conveyed to come into contact with the nip portion of the stopped registration roller pair 120. However, according to the third exemplary embodiment, when the skew of a sheet is corrected, the leading edge of the sheet is conveyed to come into contact with the planar shutter member 171.

In the third exemplary embodiment, the shutter member 171 is arranged downstream of the first conveyance roller pair 115 and upstream of the registration roller pair 120. The shutter member 171 is protruded to/retracted from the conveyance path by a driving unit (not illustrated). When the shutter member 171 is protruded to the conveyance path, the leading edge of the conveyed sheet comes into contact with the shutter member 171. In this way, the skew of the sheet is corrected. Subsequently, the shutter member 171 is retracted from the conveyance path, and the sheet is conveyed to the registration roller pair 120 and to the image forming unit. This registration roller pair 120 is different from that according to the above exemplary embodiments. The registration roller pair 120 according to the third exemplary embodiment merely conveys the conveyed sheet to the image forming unit. There is no need to stop the registration roller pair 120 to form a loop in the sheet.

Alternatively, the shutter member 171 may be arranged downstream of the registration roller pair 120. In this case, a mechanism for causing the registration roller pair 120 to come into contact with/separate from the sheet is required. Namely, when the leading edge of the sheet is conveyed to come into contact with the shutter member 171, the registration roller pair 120 is separated from the sheet. After a loop is formed by the sheet and the skew is corrected, the registration roller pair 120 is pressed together to pinch the sheet. After the shutter member 171 is retracted, the registration roller pair 120 is rotated to convey the sheet to the image forming unit.

While the exemplary embodiments have thus been described in detail, these exemplary embodiments may be combined together.

In addition, in the exemplary embodiments, the loop amount is changed based on the sheet information such as a sheet size or grammage, so that an appropriate loop amount is set when the skew is corrected. However, in an image forming apparatus having a narrow range for usable sheet sizes or grammages, a consistent loop amount may be set when the skew correction unit corrects a sheet skew, without regard for the sheet information. In this case, too, when the sheet is shifted in the width direction, the loop should be enlarged to prevent damage by twisting of the sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-277688 filed Dec. 19, 2011, which is hereby incorporated by reference herein in its entirety.

What is claimed is:

1. A sheet conveying apparatus comprising:

a first conveyance roller pair configured to nip and convey a sheet;

a second conveyance roller pair arranged downstream in a sheet conveyance direction of the first conveyance roller pair and configured to form a nip portion that comes into contact with a leading edge of the sheet conveyed by the first conveyance roller pair for forming a first loop in the sheet and to nip and convey the sheet conveyed by the first conveyance roller pair;

a width-direction shifting unit configured to shift the second conveyance roller pair in a width direction, perpendicular to the sheet conveyance direction, to shift the sheet nipped by the second conveyance roller pair in the width direction;

a first drive unit configured to rotate the first conveyance roller pair;

a second drive unit configured to rotate the second conveyance roller pair; and a control unit configured to control the first and second drive units, wherein, to form a second loop in the sheet larger than the first loop from the first loop in the sheet, the control unit controls a circumferential speed of the first conveyance roller pair to be higher than a circumferential speed of the second conveyance roller pair during at least a part of a time period between when the second conveyance roller pair starts conveying the sheet and when the width-direction shifting unit starts shifting the second conveyance roller pair in the width direction while the second conveyance roller pair nips the sheet, wherein, before the width-direction shifting unit starts shifting the second conveyance roller pair in the width while the second conveyance roller pair nips the sheet, the control unit controls the circumferential speed of the first conveyance roller pair and the circumferential speed of the second conveyance roller pair to be equal to each other, and wherein, while the width-direction shifting unit is shifting the second conveyance roller pair in the width direction while the second conveyance roller pair nips the sheet, the control unit controls the circumferential speed of the first conveyance roller pair to be equal to the circumferential speed of the second conveyance roller pair.

2. The sheet conveying apparatus according to claim 1, wherein the control unit sets a target circumferential speed of the first conveyance roller pair to be higher than a target circumferential speed of the second conveyance roller pair.

3. The sheet conveying apparatus according to claim 1, wherein the control unit sets a circumferential acceleration of the first conveyance roller pair to be higher than a circumferential acceleration of the second conveyance roller pair.

4. The sheet conveying apparatus according to claim 1, wherein the control unit determines circumferential speeds of the first and second conveyance roller pairs based on information at least about a conveyed sheet grammage or a conveyed sheet size.

5. The sheet conveying apparatus according to claim 1, wherein, after the width-direction shifting unit completes shifting the second conveyance roller pair in the width direction, the control unit maintains the circumferential speeds of the first and second conveyance roller pairs to be equal to each other.

6. The sheet conveying apparatus according to claim 1, further comprising:

a lower guide arranged upstream of the second conveyance roller pair and configured to guide the sheet conveyed by the first conveyance roller pair; and a swing guide arranged to face the lower guide, wherein, in response to the control unit controlling the first and second drive units to enlarge the first loop already formed in the sheet, the control unit swings the swing guide to expand a gap between the lower guide and the swing guide.

7. The sheet conveying apparatus according to claim 1, wherein, to form the first loop in the sheet, the control unit conveys the sheet by rotating the first conveyance roller pair at a first circumferential speed, stops the sheet before a leading edge of the sheet comes into contact with the nip portion of the second conveyance roller pair, and causes the sheet to come into contact with the nip portion of the second conveyance roller pair by rotating the first conveyance roller pair at a second circumferential speed that is lower than the first conveyance speed.

8. A sheet conveying apparatus comprising:

a first conveyance roller pair configured to nip and convey a sheet; a second conveyance roller pair arranged downstream in a sheet conveyance direction of the first conveyance roller pair and configured to form a nip portion that comes into contact with a leading edge of the sheet conveyed by the first conveyance roller pair for forming a first loop in the sheet and to nip and convey the sheet conveyed by the first conveyance roller pair;

a width-direction shifting unit configured to shift the second conveyance roller pair in a width direction, perpendicular to the sheet conveyance direction, to shift the sheet nipped by the second conveyance roller pair in the width direction;

a first drive unit configured to rotate the first conveyance roller pair; a second drive unit configured to rotate the second conveyance roller pair; and a control unit configured to control the first and second drive units, wherein, to form a second loop in the sheet larger than the first loop from the first loop in the sheet, the control unit controls a circumferential speed of the first conveyance roller pair to be higher than a circumferential speed of the second conveyance roller pair during a time period that the first conveyance roller pair accelerates to a target circumferential speed while the first conveyance roller pair nips the sheet and the second conveyance roller pair accelerates to a target circumferential speed while the second conveyance roller pair nips the sheet, wherein, after the sheet is conveyed by the first conveyance roller pair and the second conveyance roller pair in a state that the first conveyance roller pair and the second conveyance roller pair are accelerated, the width-direction shifting unit shifts the second conveyance roller pair in the width direction while the second conveyance roller pair nips the sheet, and wherein, before the width-direction shifting unit starts shifting the second conveyance roller pair in the width direction while the second conveyance roller pair nips the sheet, the control unit controls the circumferential speed of the first conveyance roller pair and the circumferential speed of the second conveyance roller pair to be equal to each other.

9. An image forming apparatus, comprising:

the sheet conveying apparatus according to claim 1; and an image forming unit configured to form an image on a sheet whose skew and width-direction position are corrected by the sheet conveying apparatus.

10. A sheet conveying apparatus comprising:

a first conveyance roller pair configured to nip and convey a sheet;

a second conveyance roller pair arranged downstream in a sheet conveyance direction of the first conveyance roller pair and configured to form a nip portion that comes into contact with a leading edge of the sheet conveyed by the first conveyance roller pair for forming a first loop in the sheet and to nip and convey the sheet conveyed by the first conveyance roller pair;

a width-direction shifting unit configured to shift the second conveyance roller pair in a width direction, perpendicular to the sheet conveyance direction, to shift the sheet nipped by the second conveyance roller pair in the width direction;

a first drive unit configured to rotate the first conveyance roller pair;

a second drive unit configured to rotate the second conveyance roller pair; and a control unit configured to control the first and second drive units, wherein, to form a second loop in the sheet larger than the first loop from the first loop in the sheet, the control unit controls a conveying amount of the first conveyance roller pair to be greater than a conveying amount of the second conveyance roller pair between when the second conveyance roller pair starts conveying the sheet and when the width-direction shifting unit starts shifting the second conveyance roller pair in the width direction while the second conveyance roller pair nips the sheet, wherein, before the width-direction shifting unit starts shifting the second conveyance roller pair in the width direction while the second conveyance roller pair nips the sheet, the control unit controls a circumferential speed of the first conveyance roller pair and a circumferential speed of the second conveyance roller pair to be equal to each other, and wherein, while the width-direction shifting unit is shifting the second conveyance roller pair in the width direction while the second conveyance roller pair nips the sheet, the control unit controls the circumferential speed of the first conveyance roller pair to be equal to the circumferential speed of the second conveyance roller pair.

11. The sheet conveying apparatus according to claim 10, wherein the control unit sets a target circumferential speed of the first conveyance roller pair to be higher than a target circumferential speed of the second conveyance roller pair.

12. The sheet conveying apparatus according to claim 10, wherein the control unit sets a circumferential acceleration of the first conveyance roller pair to be higher than a circumferential acceleration of the second conveyance roller pair.

13. The sheet conveying apparatus according to claim 10, wherein the control unit determines circumferential speeds of the first and second conveyance roller pairs based on information at least about a conveyed sheet grammage or a conveyed sheet size.

14. The sheet conveying apparatus according to claim 10, wherein after the width-direction shifting unit completes shifting the second conveyance roller pair in the width direction, the control unit maintains the circumferential speeds of the first and second conveyance roller pairs to be equal to each other.

15. The sheet conveying apparatus according to claim 10, further comprising:

a lower guide arranged upstream of the second conveyance roller pair and configured to guide the sheet conveyed by the first conveyance roller pair; and a swing guide arranged to face the lower guide, wherein, in response to the control unit controlling the first and second drive units to enlarge the first loop already formed in the sheet, the control unit swings the swing guide to expand a gap between the lower guide and the swing guide.

16. The sheet conveying apparatus according to claim 10, wherein, to form the first loop in the sheet, the control unit conveys the sheet by rotating the first conveyance roller pair at a first circumferential speed, stops the sheet before a leading edge of the sheet comes into contact with the nip portion of the second conveyance roller pair, and causes the sheet to come into contact with the nip portion of the second conveyance roller pair by rotating the first conveyance roller pair at a second circumferential speed that is lower than the first conveyance speed.

17. The sheet conveying apparatus according to claim 8, wherein the control unit sets the target circumferential speed of the first conveyance roller pair to be higher than the target circumferential speed of the second conveyance roller pair.

18. The sheet conveying apparatus according to claim 8, wherein, before the width-direction shifting unit starts shifting the second conveyance roller pair in the width direction while the second conveyance roller pair nips the sheet, the control unit controls the circumferential speed of the first conveyance roller pair and the circumferential speed of the second conveyance roller pair to be equal to each other, and wherein, while the width-direction shifting unit is shifting the second conveyance roller pair in the width direction while the second conveyance roller pair nips the sheet, the control unit controls the circumferential speed of the first conveyance roller pair to be equal to the circumferential speed of the second conveyance roller pair.

* * * * *